United States Patent [19]

Strasser

[11] 4,093,077

[45] June 6, 1978

[54] JEWELRY DISPLAY RACK

[76] Inventor: Thomas Strasser, 1500 Palisades Ave., Apt. 24B, Fort Lee, N.J. 07024

[21] Appl. No.: 787,868

[22] Filed: Apr. 15, 1977

[51] Int. Cl.[2] ..... A47F 7/02

[52] U.S. Cl. ..... 211/194; 211/13

[58] Field of Search ..... 211/194, 188, 189, 13, 211/163, 186; D6/23, 24; 108/91, 111

[56] References Cited

U.S. PATENT DOCUMENTS

| | | | |
|---|---|---|---|
| 115,456 | 5/1871 | Fisher | 211/148 X |
| D. 177,355 | 4/1956 | Wallace | D6/23 |
| 1,431,823 | 10/1922 | Leconte | 108/111 X |
| 1,878,765 | 9/1932 | Ehrlich | 211/188 X |
| 3,517,828 | 6/1970 | Hunter | 211/194 |

FOREIGN PATENT DOCUMENTS

| | | | |
|---|---|---|---|
| 735,732 | 6/1966 | Canada | 211/188 |
| 1,179,679 | 10/1964 | Germany | 211/13 |
| 6,802,097 | 8/1969 | Netherlands | 211/194 |

*Primary Examiner*—Roy D. Frazier
*Assistant Examiner*—Robert W. Gibson, Jr.
*Attorney, Agent, or Firm*—Douglas W. Wyatt; William G. Valance

[57] ABSTRACT

A novel jewelry display rack comprises a plurality of modular display frames. This jewelry rack is of variable size and capacity and may be adaptable to a variety of store situations. The rack has a base with a plurality of upwardly directed mounting rods which support a vertical stack of modular display frames. The rods pass through channels in the display frames, allowing easy assembly without special tools. The display rack may include various pleasing decorative features including a top plate, as well as a swivel base for ease of access and display.

3 Claims, 7 Drawing Figures

JEWELRY DISPLAY RACK

This invention is related to an improved jewelry display device.

Currently, there are several designs for jewelry display racks in use. In one type the number of display sites is fixed so that the capacity of the rack is fixed. Relatively large racks of this type require a definite amount of space which can be a disadvantage, when space is limited. Such racks can be bulky and difficult to handle. Alternatively, the display rack may be made in parts, but the parts often require special fasteners together with the requisite tools to complete a tedious assembly.

The novel jewelry rack of this invention avoids the disadvantages of previous jewelry racks. It comprises a plurality of vertically stacked display frames on which jewelry can be easily attached with optional jewelry mounting means. These modules are simply connected to one another by passing a plurality of upwardly directed mounting rods attached to a base through channels in the display frames adapted to receive the mounting rods so as to support the display frames in a vertical stack. Assembly can be accomplished easily without special tools.

Each modular display frame may be any desired dimension. Adjacent units must, however, conform with one another. Preferred construction material for the frames is clear lucite. Not only can each desired display unit be of variable capacity, but the overall capacity of the display rack can be varied by connecting together a variable number of the modular display units.

It is an object of this invention to provide a novel jewelry rack of easily variable capacity.

It is a further object of this invention to provide a variable capacity jewelry rack that is easy to assemble requiring few tools.

It is also an object of this invention to provide a jewelry rack comprised of a plurality of display units conforming to each other so as to form stable vertical structures.

It is also an object of this invention to provide a rotatable, variable capacity jewelry rack that has improved aesthetic qualities.

BRIEF DESCRIPTION OF THE DRAWINGS

The advantages of this invention will now be made apparent with reference to the following figures.

DETAILED DESCRIPTION

Figure 1:
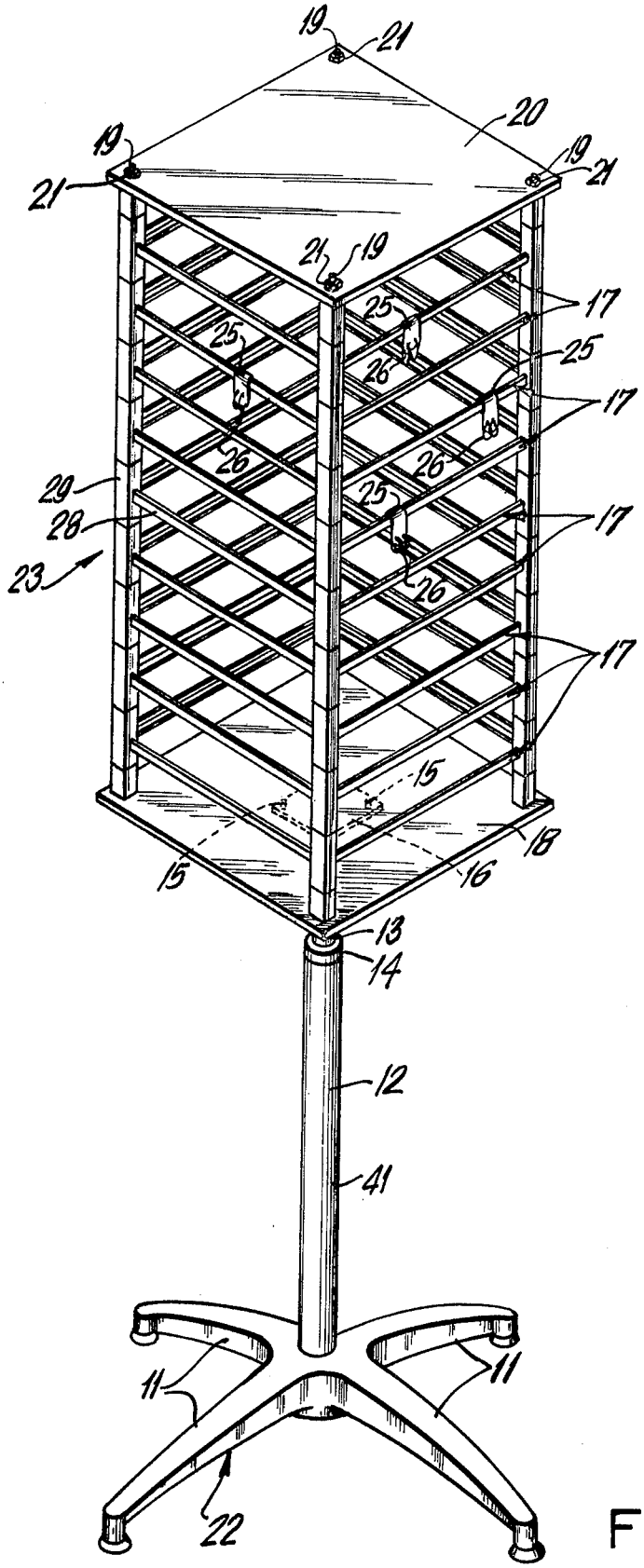
FIG. 1 shows a top perspective view of the novel jewelry display rack of this invention with jewelry 26 mounted thereon.
Figure 2:
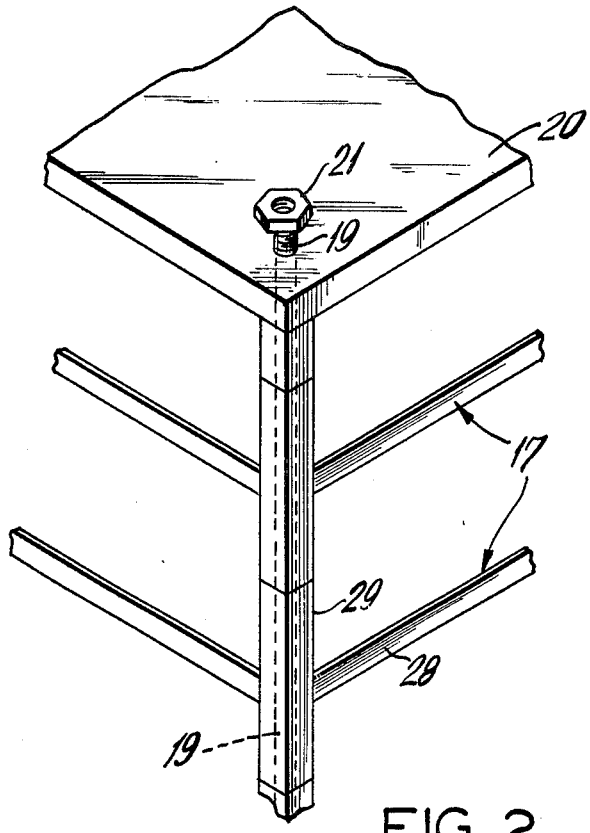
FIG. 2 is an enlarged top perspective cutaway view of the top portion of the novel jewelry rack of this invention shown in FIG. 1.
Figure 3:
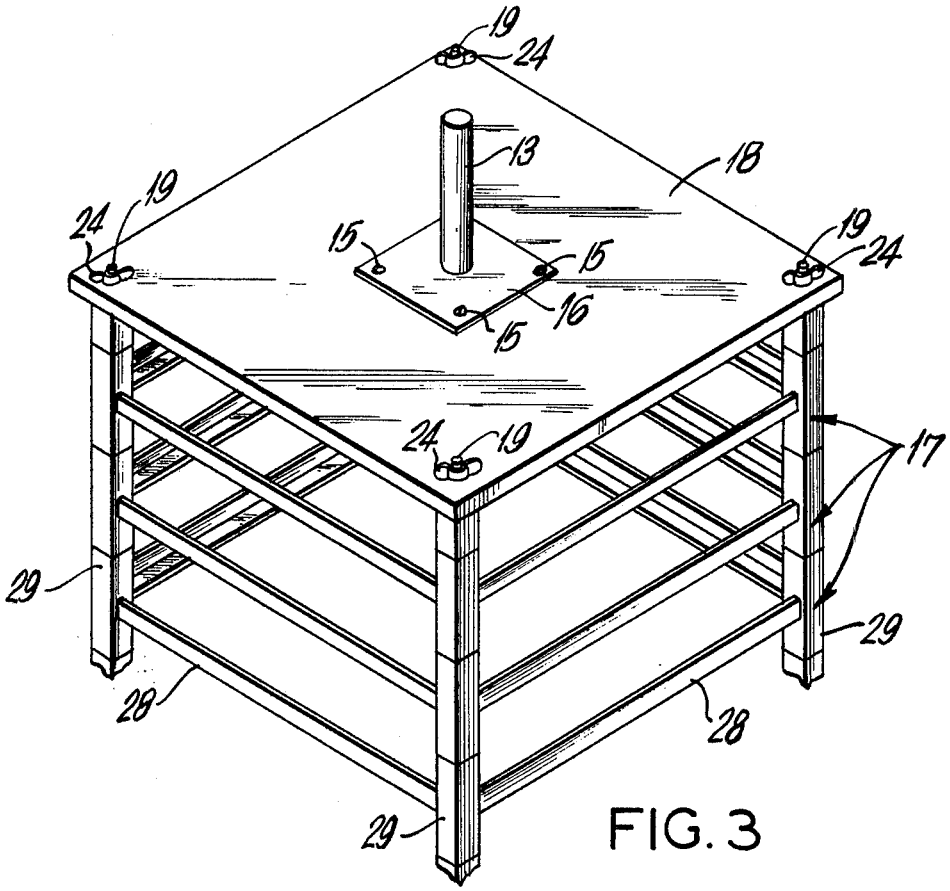
FIG. 3 is a bottom perspective view of the rack body 23 having a plurality of modular display frames 17.

In FIGS. 1 to 3 it is shown that the jewelry rack body 23 is comprised of a plurality of vertically stacked modular display frames 17 supported on bottom plate 18 of base 22 by upwardly directed mounting rods 19 attached to said bottom plate 18. Mounting rods 19 support the rack body 23 by passing substantially vertically through the channels 27 in each of the four corner posts 29 of the modular display frame 17 shown in greater detail in FIGS. 5 and 6. A rack top plate 20 may be secured to the topmost display frame 17 of the rack body 23 by the nuts 21 attached to the threaded ends of the mounting rods 19 as shown in FIG. 2. The rack bottom plate 18 is secured to the rack body 23 with nuts 24 attached to the threaded ends of the mounting rods 19 as shown in FIG. 3. In this embodiment the base 22 for support of rack body 23 comprises a bottom plate 18 and a swivel base unit 41. The swivel base unit 41 comprises a swivel base 16 attached by swivel base screws 15 to the rack bottom plate 18, a swivel 13 attached to swivel base 16, for example, by welding; a hollow chrome tube 12 having plastic bushing 14 adapted to receive said swivel 13 so as to assist rotation of the swivel 13 in the chrome tube 12 and three feet 11 attached preferably by welding to said chrome tube 12.

Figure 4:
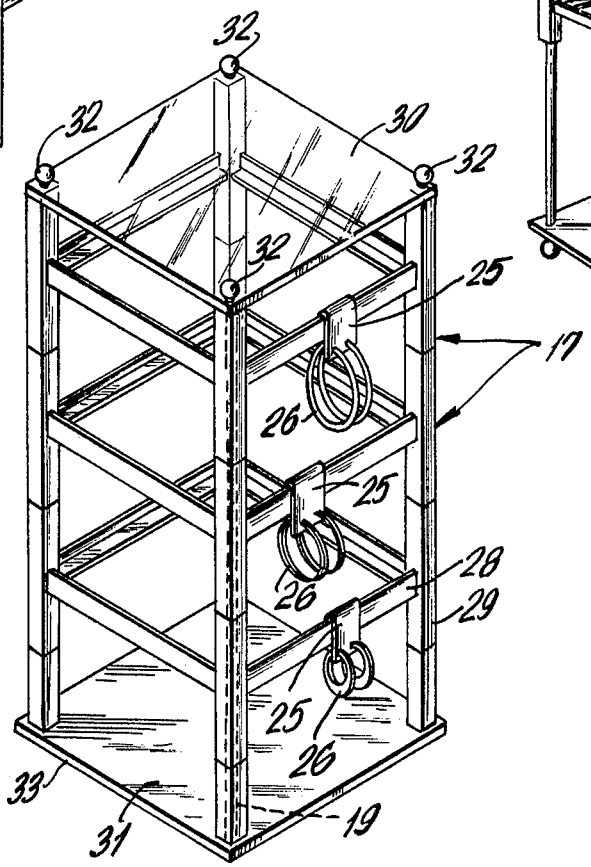
FIG. 4 is a top perspective view of another embodiment of the novel jewelry rack of this invention.

A second nonrotatable embodiment of this invention is shown in FIG. 4. It is comprised of a plurality of modular display frames 17 vertically supported by the mounting rods 19 passing through channels 27 as in the first embodiment, a rack top plate 30 and a rack base 31. The rack top plate 30 is attached to the top of the jewelry rack by screwing the decorative nuts 32 to the threaded ends of the rods 19. The rack bottom plate 31 is attached to the bottom of the jewelry rack as shown in FIG. 3. The bottom plate 31 is equipped with a downwardly turned lip 33 around its periphery so that it can rest on a display case.

Figure 5:
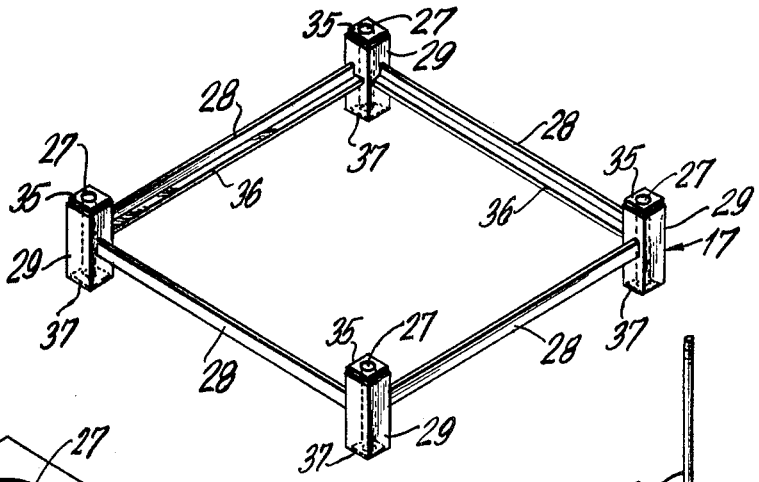
FIG. 5 is a top perspective view of a rectangular modular display frame 17.
Figure 6:
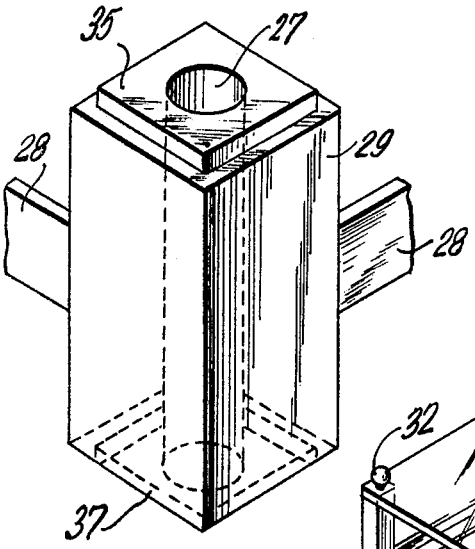
FIG. 6 is an enlarged cutaway top perspective view of a corner of display frame 17.
Figure 7:
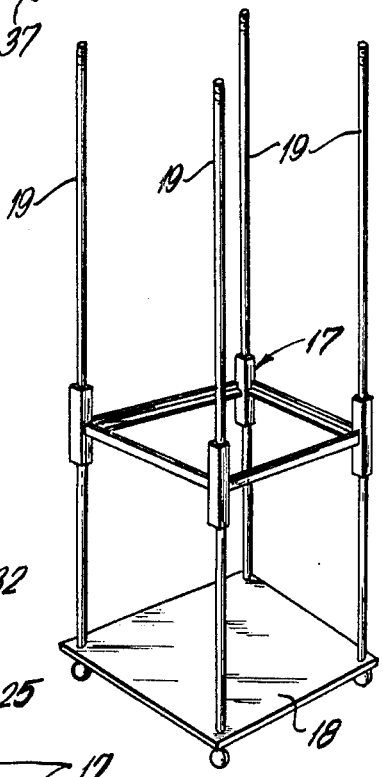
FIG. 7 is a perspective view showing assembly of the jewelry rack.

The details of the modular display frame 17 are shown in FIG. 5. Each display frame 17 is comprised of a plurality of vertically disposed corner posts 29 connected by jewelry mounting frame members 28. Each jewelry mounting frame member 28 may be a straight beam having a substantially vertical L-shaped cross-sectional area so as to have an inwardly directed lip 36. This lip 36 can be used to assist tracking and mounting of jewelry display mounting means 25. Furthermore, as shown in FIG. 6, each corner post 29 may be provided with an upwardly projecting area 35 on its top and a recessed area 37 on its bottom, said upwardly projecting areas 35 conforming and fitting into said downwardly directed recess 37 on its neighboring modular display frames 17 to form a vertical stack of display frames 17 of substantial stability. The preferred material for construction of the display frame 17 is clear lucite.

In operation, both of these embodiments can be assembled rapidly by sliding the modular display frames 17 over the mounting rods 19 and attaching top plate 20 (or 30) and the bottom plate 18 (or 31) to the jewelry mounting rods 19 by the nuts 24 and 21 (or 32) as shown in FIG. 6. Jewelry 26 may be attached to both racks by optional jewelry mounting means 25.

I claim:

1. A novel jewelry rack providing a variable capacity storage and ease of assembly comprising:

a base for supporting the jewelry rack in the display area;

said base having a plurality of mounting rods extending generally upwardly from and attached to said base to support said jewelry rack;

a plurality of vertically stacked modular display frames adapted for display of jewelry and supported by said mounting rods; each of said modular display frames having a plurality of corner posts and jewelry mounting frame members connecting said corner posts, each of said corner posts having a substantially vertical channel each adapted to receive one of said mounting rods, so that said modular display frames are supported in a vertical stack of variable capacity upon which jewelry is displayed and wherein the bottom of each corner post is substantially horizontal and has a recessed area, the top of each of said corner post being substantially horizontal, having an upwardly projecting area conforming with the upper adjacent recessed area in the bottom of the corner post of the modular display frame stacked above so as to provide for easier assembly of the jewelry rack by improving the stability of the vertical stack of modular display frames and wherein said jewelry mounting frame member is a straight beam having a substantially vertically disposed L-shaped cross section, the horizontal protion of said L-shaped cross section being directed toward the interior of said modular display frame so as to form an interior lip on said beam to facilitate attachment of jewelry mounting means to said jewelry mounting frame member.

2. A novel jewelry display rack as described in claim 1, wherein each of said modular display frames has four of said corner posts connected by four of said jewelry mounting frame members so as to form a rectangle.

3. A novel jewelry display rack as described in claim 2, wherein said plurality of vertically stacked modular display frames has attached to the top of the uppermost modular display frame a horizontally disposed flat top plate for further support and decorative effect.

* * * * *